US006145429A

United States Patent [19]

Paul

[11] Patent Number: 6,145,429

[45] Date of Patent: Nov. 14, 2000

[54] ROTOR ASSEMBLY FOR ROTARY POWER DEVICE

[76] Inventor: Eddie Paul, 414 W. Walnut, El Segundo, Calif. 90245

[21] Appl. No.: 09/263,560

[22] Filed: Mar. 8, 1999

[51] Int. Cl.[7] ..... F01B 3/00

[52] U.S. Cl. ..... 92/33; 417/269; 91/499; 123/43 AA

[58] Field of Search ..... 92/33; 417/269; 123/43 A, 43 AA

[56] References Cited

U.S. PATENT DOCUMENTS

| | | | |
|---|---|---|---|
| 1,614,476 | 1/1927 | Hutchinson | 123/43 AA |
| 5,209,190 | 5/1993 | Paul . | |
| 5,794,513 | 8/1998 | Kristensen | 92/57 |

*Primary Examiner*—Timothy S. Thorpe
*Assistant Examiner*—Ehud Gartenberg

[57] ABSTRACT

A rotor assembly for a rotary power device consists of two opposed rotor sections which when assembled in the stator of the device have limited movement parallel to the axis of rotation of the rotor assembly. Each rotor section includes through running cylinders and a center passage for a drive shaft when the sections are assembled. Each rotor section defines inwardly extending support legs and a rear face which act to limit the travel of the rotor sections towards one another. The number of support legs is equal to one half of the number of cylinders in the rotor assembly. The base of the support legs includes a socket which is aligned with a socket in the rear face of the opposing rotor section. A guide pin and spring are disposed in the socket of the support leg and the guide pin extends from the socket into the rear face socket when the rotor sections are assembled. The spring acts to normally urge the rotor sections away from one another so that the end walls of the rotor assembly are in contact with the end walls of the stator of the rotary power device. In the event of expansion of the components of the rotary power device during operation, the rotor sections can move towards one another against the urging of the spring thus avoiding excessive contact pressure between the end walls of the rotor sections and the stator.

8 Claims, 6 Drawing Sheets

ROTOR ASSEMBLY FOR ROTARY POWER DEVICE

FIELD OF THE INVENTION

This invention relates to rotary power devices such as rotary internal combustion engines, pumps and compressors and more particularly to a rotary power device having a self adjusting rotor for maintaining proper contact between the rotor and the end walls of the stator.

BACKGROUND OF THE INVENTION

Rotary power devices, also referred to as cylindrical energy modules (CEM) are described in the U.S. Pat. No. 5,209,190, granted May 11, 1993 to Eddie Paul. The CEM is a device capable of functioning as a highly efficient positive displacement pump, as a compressor or, with minor modifications, as an internal combustion engine. As a pump, the CEM is self priming and is capable of pumping both gases and liquids or combinations of liquid and gas which renders it highly suited for the production and pumping of foam, such as fire fighting foam.

It has been found, however, that in the manufacture of the CEM, tolerance between the end walls of the CEM housing forming the stator and the rotor assembly end walls is critical. If the tolerances are too close the rotor Assembly will seize up causing a complete malfunction of operation of the CEM. On the other hand, if the tolerances are to loose the efficiency of the CEM will be substantially reduced. Maintaining the proper clearance between the rotor assembly and the stator end walls requires highly skilled machining operations calling for extremely close tolerances which substantially increase the cost of manufacturing the CEM. Even where the machining tolerances are held, in has been found that occasionally during the operation of the CEM buildup of heat will cause the rotor assembly and the stator to expand resulting in galling of the cylinder heads and stator end walls or complete malfunction of the device due to seizing of the rotor assembly.

SUMMARY OF THE INVENTION

Is an object of the present invention to reduce the criticality of tolerance between the end walls of the rotor assembly and the end wall of the CEM stator.

It is another object to reduce the manufacturing cost of the CEM.

It is yet another object to provide a rotor assembly that maintains correct contact between the rotor assembly and the CEM stator end walls during the operation of the device.

In accordance with the invention the rotor assembly comprises two components which are assembled for axial movement in the stator with respect to one another. Spring elements are provided to normally urge the components of the rotor assembly away from each and toward the respective end walls of the stator. In operation the components are urged by the spring elements to maintain proper contact between the end walls of each of the components and the stator end wall of the CEM device. The components are thus free to move or float during operation of the CEM device so that excessive wearing and seizing of the rotor assembly components and the end walls of the CEM stator are eliminated. In this same manner the manufacturing tolerances are substantially loosened and the cost of manufacturing the CEM is substantially reduced.

These and other objects and advantages of the present invention will become apparent from the following description of the preferred embodiments of the invention taken in conjunction with the drawings.

DESCRIPTION OF THE PREFERRED EMBODIMENTS

The device illustrated herein is adapted for use as a pump although, as mentioned above, the device is equally useful as a compressor, vacuum pump or as an engine with only relatively minor modifications such as, for example, the provision of suitable fuel inlet means and ignition means for operation as an internal combustion engine. The CEM device is likewise readily adapted for use as an air driven power device or as a steam engine. For purpose of illustration the invention will be described herein in connection with a CEM for compressing air. As mentioned above, however, the invention is not intended to be so limited.

Figure 1:
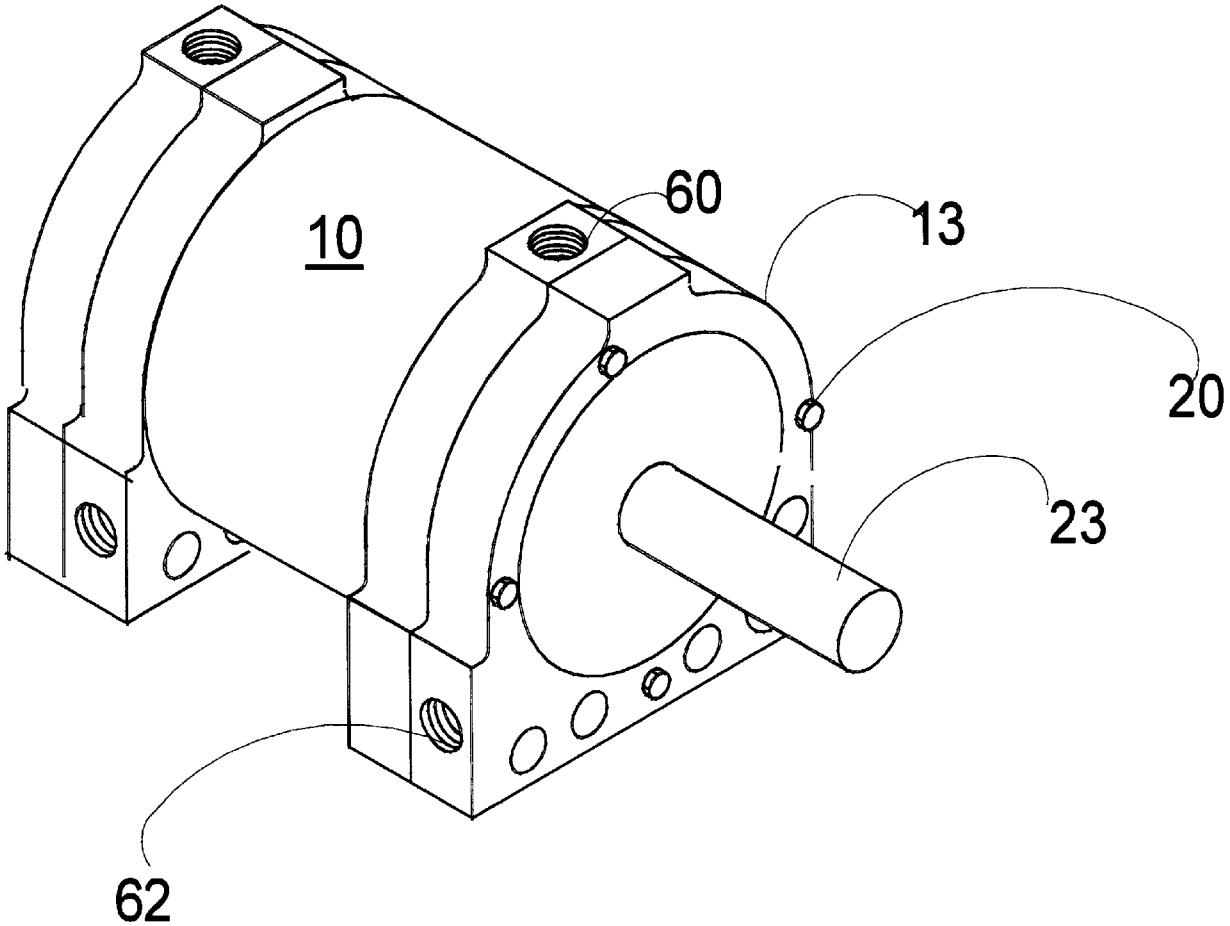
FIG. 1 is a perspective of view of the exterior of a CEM pump designed in accordance with the invention.
Figure 2:
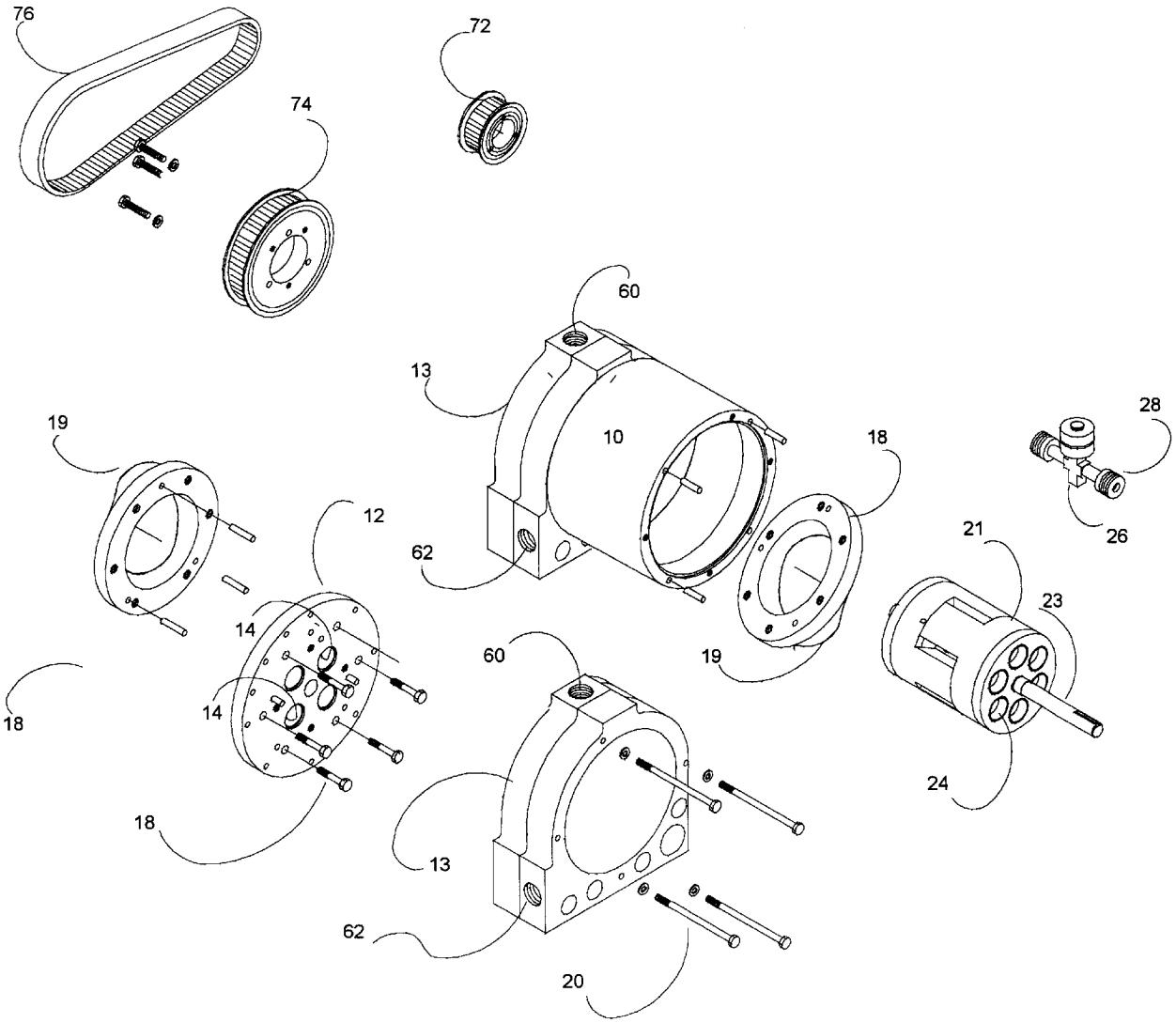
FIG. 2 is an exploded perspective view of the pump illustrated in FIG. 1.

As illustrated in FIGS. 1 and 2, the CEM device comprises a stator 10 consisting of an cylindrical housing having a bore defining an interior of the housing which is closed by end walls 12. A manifold 13 is secured by suitable means, such as by bolts 20 at each end of the stator 10. Each manifold 13 is provided with an inlet 60 for introduction of fluid to be pumped and an outlet 62 for egress of the fluid being pumped. A suitable line (not shown) communicates between a source of fluid and the inlet 60. Likewise a line (not shown) connects the outlet 62 to a storage or end user location. The end walls are provided with ports 14 which communicate with their respective manifolds 13. In the embodiment illustrated the end walls 12 are provided with four ports 14 which are radially disposed equiangularly about each of the end walls 12. In the four port configuration, each port 14 is disposed on the end wall 12 at 90 degrees with respect to the adjacent ports. The end walls 12 are likewise secured to the stator 10 by means of bolts 18.

A rotor, shown generally as 21, comprises a central drive shaft 23 which extends axially through the bore of the stator 10. The drive shaft 23 is rotatably journaled at each of the stator end walls 12. As illustrated in FIG. 2, the rotor 21 has four cylinders 24 which are disposed parallel to each other and parallel to the axis of the drive shaft 23. Slidingly disposed in each of the cylinders 24 is a reciprocating piston 26 having a piston head 28 on each end and a piston pin assembly 30 which is disposed medially on the piston 26 and which extends normal to the axis of the piston 26 for projection through a slot (not shown) provided in the side wall of each cylinder. The extending end of each piston pin 30 is provided with a cam follower 34 which is configured to be received in a sinusoidal cam track defined between cam bodies 18 having opposed milled track halves 19. The cam bodies 18 are disposed in the stator 10 on each of the end walls 12. To reduce friction, the cam follower 34 of the piston pin assembly 30 may be rotatably carried on the piston pin so as to serve as a roller in the cam track formed by the cam bodies 18. An electric motor (not shown) carrying a drive pulley 72 on its drive shaft transfers driving power to the CEM by means of a drive belt 76 and idler pulley 74 mounted on the drive shaft 23 of the CEM In operation, power is applied to the drive shaft 23 by the electric motor to cause rotation of the rotor 21 within the stator 10. Rotation of the rotor 21 causes the pistons 26 to reciprocate in their respective cylinders 24 through the action of the cam followers in the cam track formed between the opposed cam bodies 18 as the rotor 21 rotates with respect to the stator 10. Each piston head 28 operates on a two stroke cycle to draw air into the cylinder and to compress the air during the compression stroke. During the intake stroke, pressure is reduced in an area defined by the piston head 28, the walls of the cylinder 24 and the end wall surface of the stator 10. As the rotor 21 is rotated in the stator the cylinders 24 move around the end wall 12 and come into alignment with a port 14. During the intake stroke the air is drawn into the defined area and the compression stroke begins as cylinder 24 element moves out of alignment with the port 14 and the piston head 28 begins moving toward the end wall 12 to reduce the volume of the defined space and to initiate compression of the air therein. At the completion of the compression stroke the piston head 28 reaches top dead center and a maximum compression at the piston head is reached. As the cylinder 24 moves into alignment with the next port 14 the compressed air exits the port into the manifold, the manifold outlet 62 and a line (not shown) which leads the compressed air to receiving tank or a user device (not shown). It will be understood that as one head 28 of a piston 26 is in the compression cycle, the piston head on the opposite end is in the intake stroke. Each of the piston heads Thus, each piston 26 operates as two pistons. Each of the piston heads 28 complete 2 intake and compression cycles during a complete rotation of the rotor 21. In the embodiment shown the rotor 21 is provided with 6 cylinders 24 so that one complete revolution of the rotor provides the effect of 24 pistons.

Ideally, the end faces of the rotor 21 should make slight contact with the facing surface of the end walls 12 of the stator 10. In actual practice the components, particularly the rotor end faces and the facing surface of the end walls 12 of the stator 10 are milled to provide a very small clearance between the two components. If the contact pressure is too great or if there is expansion of the components during operation, the end faces of the rotor 21 will contact the facing surfaces of the end walls 12 with sufficient pressure to cause galling or undue wear between the rotor end faces and the end wall 12 or may actually result in seizing of the rotor 21 against the end wall 12. On the other hand if the clearance between the rotor end faces and the end wall 12 is too large the efficiency of the pump is substantially reduced due to loss of compression between the end wall and the piston head. Thus, in manufacturing the CEM device, the milling tolerances of the end faces of the rotor 21 and the end walls 12 are extremely critical and the machining operation is time consuming and costly.

As mentioned above, the components of the CEM device and their function are more completely described in the U.S. Pat. No. 5,209,190, granted May 11, 1993.

Figure 3:
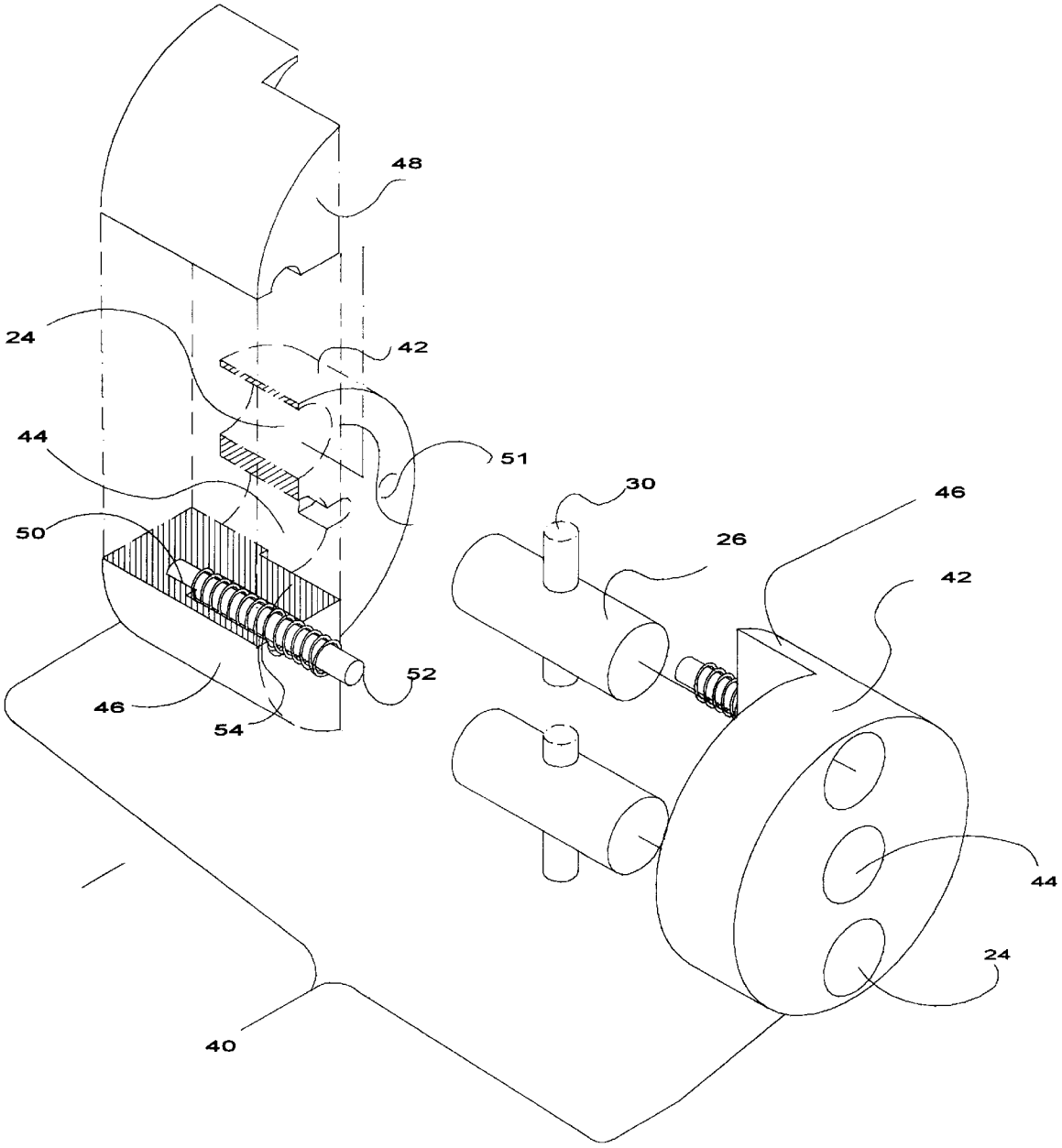
FIG. 3 is a perspective view, partially in section, of the rotor assembly of the of the FIG. 1 illustrating the location of a pair of spring loaded pins in accordance with the invention.

In accordance with the invention and with reference to FIG. 3, a self adjusting rotor assembly 40 comprises first and second opposed rotor sections 42 each defining an end face 43. The first and second opposed rotor sections 42 are free to float or move in the stator 10 parallel to the axis of the drive shaft (not shown). In this manner the rotor assembly 40 maintains the proper contact between the end faces 43 and the end walls 12 despite heating and expansion of the rotor assembly 40 during operation of the pump. In addition, the milling tolerances which must be held during manufacture of the CEM devise are substantially loosened since the rotor assembly 40 is self adjusting with respect to contact between the end faces 43 of the rotor assembly 40 and the facing surfaces of the end walls 12.

Figure 4:
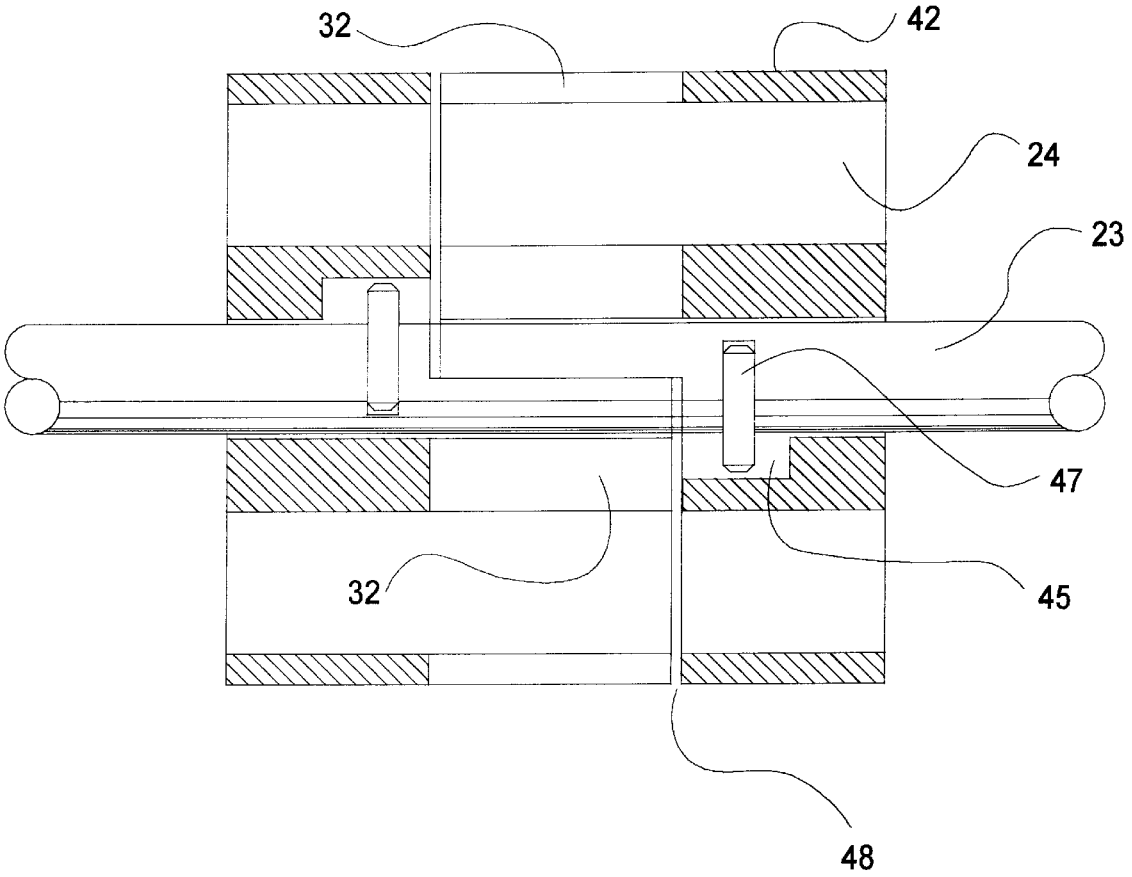
FIG. 4 is a sectional view showing the connection of the drive shaft and rotor sections.
Figure 5:
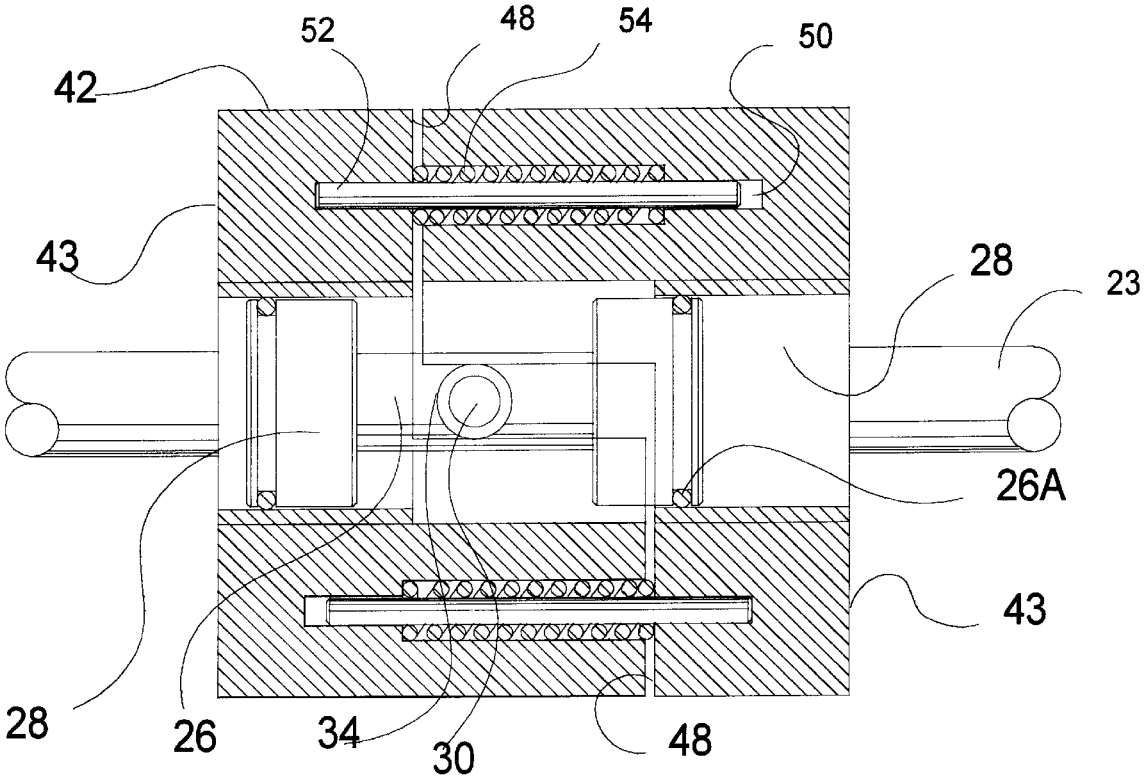
FIG. 5 is a top sectional view of the rotor assembly of FIG. 3.

Referring to FIGS. 3, 4 and 5, in which like reference numbers denote like parts already described, the rotor assembly 40 comprises two sections 42 in each of which are formed two cylinders 24 which open at the end face 43 of the rotor sections. When the rotor sections 42 are assembled in the stator 10, the cylinders 24 formed in each rotor section 42 are aligned to receive a single piston body 26 having two piston heads 28. A center passage 44 is provided in each section for receiving a drive shaft (not shown) which is rotatably journaled in a bearing assembly (not shown). As most clearly shown in FIG. 4, a slot 45 is provided in the passage 44 for receiving a key 47 on the drive shaft 23 to fix the rotor sections 42 on the drive shaft for rotation therewith while permitting the rotor sections to move along the drive shaft parallel to its axis.

For simplicity of description, the rotor assembly 40 illustrated in FIGS. 3, 4 and 5 is shown as having only two cylinders 24 in each rotor section 42. However, it will be understood that the rotor assembly 40 may comprise four or more cylinders 24. For example, in an embodiment shown and described below in conjunction with FIGS. 6 and 7, the rotor assembly 40 has six cylinders 24.

A portion of the circumference of the each rotor section 42 is longitudinally extended to define an inwardly extending support leg 46 for contact with the rear face 48 of the opposed rotor section. The support leg 46 of the first rotor section 42 is disposed on a side of the first rotor section opposite to the side on which the support leg of the second rotor section is disposed so that as assembled in the stator 10 the legs are free to contact the rear face of the opposing rotor section. In addition, the width of the support legs are dimensioned so that as assembled the legs are spaced apart to define the sides of the elongated slots 32 through which the piston pins 30 may project. The ends of each of the slots 32 are defined by the adjacent unextended peripheral portion of the first and second rotor sections 42. The extending end of the support leg 46 of each of the rotor sections 42 is provided with aligned blind holes which define a socket 50 for receiving a guide pin 52 on which the rotor sections are free to slide. The guide pins 52 are substantially longer than an individual socket 50 so as to extend into the corresponding aligned socket 51 in the rear face 48 of the opposed rotor section. The socket 50 in the extending support leg 46 is counterbored and receives a spring 54 which surrounds the guide pin 52. As shown in FIG. 3, the spring 54 is relaxed and extends beyond the socket 50 of the extending leg 46. When assembled the spring 54 is compressed by contact with the rear face 48 of the opposite rotor section 42 and thereby provides force to normally urge the rotor sections 42 apart. In this manner the rotor assembly 40 is adjusted so that the end face 43 of each rotor section 42 maintains uniform and controlled contact the surface of the end wall 12 of the stator 10. By maintaining such uniform and controlled contact between the end faces 43 of the rotor assembly 40 and the inward facing surface of the end wall 12, the manufacturing tolerances can be far less critical since the rotor assembly 40 is self adjusting in the stator 10 for contact between the end faces 43 of the rotor assembly 40 and the inner surface of the stator end walls 12 and it is unnecessary to machine the rotor and end walls to hold a space there between. Heretofore such contact was very difficult if not impossible to achieve. Likewise, in the event the pistons 26 or other components of the CEM device were to expand during operation, the increased pressure between the end faces 43 and the inner surfaces of the end walls 12 will cause each of the rotor sections 42 to move inwardly toward its opposed rotor section against the compressive force of the springs 54 to relieve the excessive contact pressure between the rotor assembly 40 and the end walls 12 and thus prevents unnecessary wear between the end faces 43 of the rotor sections 42 and the inner surface of the end wall 12 of the stator 10. Without the self adjusting rotor assembly such excessive contact pressure would produce excessive wear which, in the worst case, would cause the rotor assembly 40 to seize in the stator 10, or at least reduce pump efficiency due to such excess wear.

It will be understood that the selection of spring strength is a matter of choice depending upon the type of CEM device, the materials of construction of the device and other operating parameters such as operating revolutions per minute of the rotor and the like. Likewise, due to the and simplicity of the CEM device, it may be readily disassembled and the springs 54 replaced by springs 54 of greater or lesser compressive strength as operating conditions for the device change.

Figure 6:
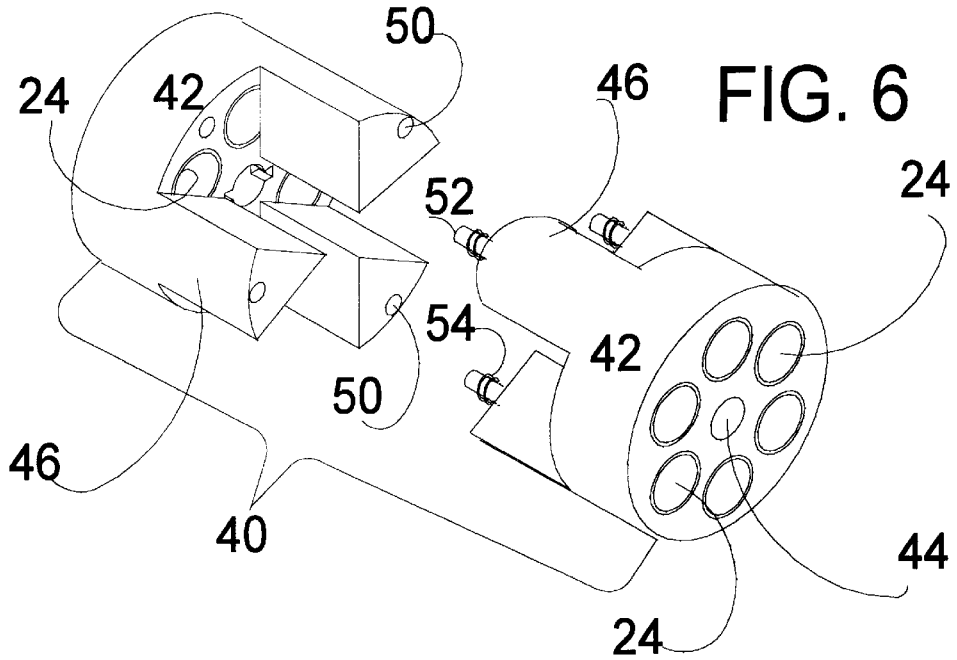
FIG. 6 is an exploded perspective view of a rotor assembly illustrating another embodiment of the invention.
Figure 7:
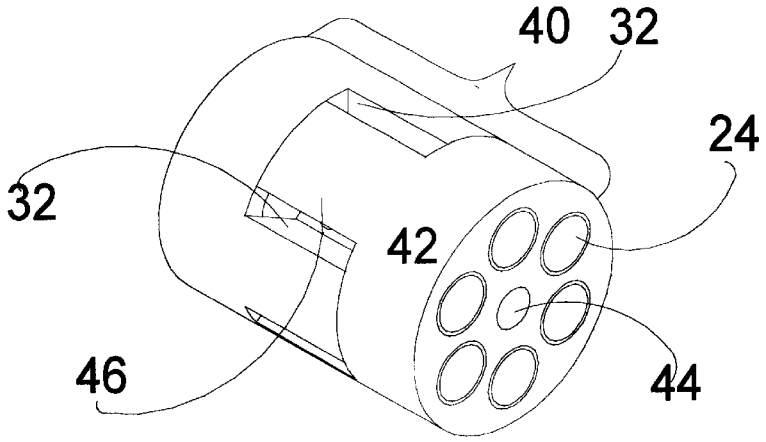
FIG. 7 is a perspective view of the assembled components of FIG. 6.

Referring to FIGS. 6 and 7, where like reference numbers denote like parts, a rotor assembly 40 having 6 cylinders 24 is illustrated. In this embodiment of the invention the rotor assembly 40 consists of two sections as described above in connection with the rotor assembly 40 shown in FIGS. 1–5. Each rotor section 42 includes a central shaft passage and six open ended cylinders 24 spaced equiangularly about the circumference of the rotor section and three inwardly extending support legs 46. As assembled, the shaft passage and the cylinders 24 of each section are aligned.

The three extending support legs 46 are formed on each of the rotor assembly 40 sections. The support legs 46 are disposed on each section so that when the sections are assembled the legs 46 of one rotor section 42 will extend between the legs 46 of the other rotor section with spacing there between defining the sides of the elongated slots 32 through which the piston pins 30 extend. As described, the base of each support leg 46 is provided with a counterbored socket 50 in which is disposed a guide pin 52 and spring. The guide pin 52 and spring 54 extend from the base of the support leg in the manner already described. A corresponding socket 50 is formed on the inner face of the opposite rotor section 42 for receiving the extending end of a guide pin 52 when the rotor sections 42 are assembled. The extending end of the spring 54 contacts the surface of the rotor section 42 and is compressed as the sections are moved towards one another.

The operation of this embodiment of the invention is the same as described above for the two cylinder rotor except that there are 24 input and compression strokes with each revolution of the rotor assembly.

As mentioned above, while the invention and its preferred embodiments have been described as a pump, it will be understood that the rotor assembly 40 constructed in accordance with the present invention can be used in a CEM device adapted as a compressor or as a motor. In addition the CEM device can consist of a combined motor and pump or compressor by adapting one end of the device as a motor and the opposite end the device as a pump or compressor.

The rotor assembly 40 of the present invention eliminates the necessity of machining the cylinder heads and end walls 12 of the CEM device to very close tolerances as the rotor assembly self adjusts to make contact between the cylinder heads and the end walls 12 of the stator. In addition the rotor assembly 40 will adjust to expansion and contraction of the rotor assembly and the stator 10 due to heating or cooling of the CEM device. Thus, a rotor assembly 40 designed in accordance with the present invention will substantially reduce the machining cost in fabricating the CEM device. In addition the self adjusting feature of the rotor assembly 40 also reduces excessive wear or complete failure of the device to expansion or contraction of the rotor assembly and the stator 10 with respect to each other.

As will be understood by those skilled in the art, various arrangements of other than those described in detail in the specification will occur to those persons skilled in the art, which arrangements lie within the spirit and scope of the invention. It is therefore be understood that the invention is to be limited only by the claims appended hereto.

Having described the invention, I claim:

1. In a rotary power device adaptable for use as an engine, pump or compressor, said device comprising a rotor assembly having at least a pair of cylinders, a stator defining a side wall and end plates defining end walls which cooperate to form an interior for receiving said rotor assembly, a sinusidal cam track formed in said side wall extending about the circumference of said stator, said rotor assembly being carried by a drive shaft for rotation in said stator interior, said cylinders opening at each end of said stator for intermittent communication with ports formed in said stator end walls, a piston body having a piston head at each end slidably disposed in each of said cylinders for reciprocating movement therein, a piston pin disposed on each said piston extending normal to the axis of said piston for projection into said sinusoidal cam track to serve as a cam follower for reciprocating said pistons responsive to the rotation of said rotor, the improvement comprising:

a. said rotor assembly consisting of first and second opposing cylindrical rotor sections, said first and second opposing rotor sections each defining an end face for contact with a respective one of said stator end walls and an inner surface facing said opposing rotor section, said first and second sections being movable with respect to one another in said shaft in a direction parallel to the axis of rotation of said rotator, b. an inwardly extending support leg being formed on said inner surface of said first and second rotor sections, said support leg defining an extended end for supporting said rotor sections on one another and for limiting the travel of said rotor sections towards one another;

c. at least two through running cylinders opening at the end face and the inner surface of said first and second rotor sections, each of said cylinders in said first rotor section being aligned with a corresponding cylinder in said second rotor section when said rotor sections are assembled in said stator; and d. spring means disposed between said first and second rotor sections being normally compressed when said rotor sections are assembled in said stator for urging said first and second rotor sections apart;

whereby contact is maintained between said end face of said first and second rotor sections and a respective end wall of said stator, and said rotor sections move inwardly against the urging of said spring means as components of said rotary power device expand due to heating, and move outwardly as said components contract due to cooling.

2. The rotary power device of claim 1 wherein said support leg of each of said first and second rotor sections includes a socket for receiving said spring means.

3. The rotary power device of claim 1 wherein said spring means comprises a coil spring surrounding a pin having an end thereof received in said socket of said support leg and the opposite end thereof extending from said socket for compressing contact with said rear face of said opposing rotor section.

4. The rotary power device of claim 1 wherein said support legs of said first and second rotor sections are spaced apart and cooperate with an adjacent peripheral section of said rotor section to define a pair of elongated slots on opposite sides of said rotor assembly side wall when said rotor sections are assembled in said stator.

5. The rotary power device of claim 1 wherein each said rotor section is provided with a center passage for the extension there through of said drive shaft, said center passage having a slot provided therein for receiving a key on said drive shaft thereby to fix said rotor sections on the drive shaft for rotation therewith while permitting said rotor sections limited movement along the drive shaft parallel to its axis.

6. The rotary power device of claim 1 wherein the number of support legs on said each of said first and second rotor sections is equal to one half of the number of cylinders in each of said first and second rotor sections.

7. The rotary power device of claim 6 wherein said first and second rotor sections each include six cylinder bores and three inwardly extending support legs.

8. The rotary power device of claim 6 wherein said first and second rotor sections each include four cylinder bores and two inwardly extending support legs.

* * * * *